US011812787B2

(12) United States Patent
Liu

(10) Patent No.: US 11,812,787 B2
(45) Date of Patent: Nov. 14, 2023

(54) ATOMIZATION ASSEMBLY AND ELECTRONIC CIGARETTE COMPRISING THE SAME

(71) Applicant: Tuanfang Liu, Shenzhen (CN)

(72) Inventor: Tuanfang Liu, Shenzhen (CN)

( * ) Notice: Subject to any disclaimer, the term of this patent is extended or adjusted under 35 U.S.C. 154(b) by 593 days.

(21) Appl. No.: 17/012,092

(22) Filed: Sep. 4, 2020

(65) Prior Publication Data

US 2021/0186101 A1 Jun. 24, 2021

(30) Foreign Application Priority Data

Dec. 23, 2019 (CN) ..... 201911344729.X
Dec. 23, 2019 (CN) ..... 201922326895.9

(51) Int. Cl.
*A24F 40/42* (2020.01)
*A24F 40/48* (2020.01)
*A24F 40/46* (2020.01)

(52) U.S. Cl.
CPC ..... *A24F 40/42* (2020.01); *A24F 40/46* (2020.01); *A24F 40/48* (2020.01)

(58) Field of Classification Search
CPC ..... A24F 40/42
See application file for complete search history.

(56) References Cited

U.S. PATENT DOCUMENTS 9,867,399 B1 * 1/2018 Liu ..... A24F 40/42
2015/0144147 A1 * 5/2015 Li ..... A24F 40/485 392/390
2016/0100633 A1 * 4/2016 Gao ..... A24F 40/53 131/329
2022/0015426 A1 * 1/2022 Lau ..... A24F 40/485

* cited by examiner

*Primary Examiner* — Philip Y Louie
*Assistant Examiner* — Miles A Simpson
(74) *Attorney, Agent, or Firm* — MATTHIAS SCHOLL P.C.; Matthias Scholl

(57) ABSTRACT

An atomization assembly, including an e-liquid tank, a connector, a seal ring, a spring, a first fixed ring, an atomizer, a silicone seal, a silicone plug, and a base. The spring is disposed in the seal ring. The seal ring is disposed around the connector. The connector, the seal ring, and the spring are disposed in the first fixed ring. The silicone seal is disposed on the base. The base is disposed on the e-liquid tank. Two ends of the first fixed ring are connected to the base and the e-liquid tank, respectively. The silicone plug is fixed on the base. The atomizer is fixed on the first fixed ring.

4 Claims, 5 Drawing Sheets

ATOMIZATION ASSEMBLY AND ELECTRONIC CIGARETTE COMPRISING THE SAME

CROSS-REFERENCE TO RELATED APPLICATIONS

Pursuant to 35 U.S.C. § 119 and the Paris Convention Treaty, this application claims foreign priority to Chinese Patent Application No. 201911344729.X filed Dec. 23, 2019 and to Chinese Patent Application No. 201922326895.9 filed Dec. 23, 2019. The contents of all of the aforementioned applications, including any intervening amendments thereto, are incorporated herein by reference. Inquiries from the public to applicants or assignees concerning this document or the related applications should be directed to: Matthias Scholl P.C., Attn.: Dr. Matthias Scholl Esq., 245 First Street, 18th Floor, Cambridge, Mass. 02142.

BACKGROUND

The disclosure relates to an atomization assembly and an electronic cigarette comprising the same.

Conventional electronic cigarettes are an integrated structure; the atomization assembly is difficult to separate from the battery assembly. In addition, the e-liquid tends to leak out upon replacing the atomizer with a new one.

SUMMARY

The disclosure provides an atomization assembly comprising an e-liquid tank, a connector, a seal ring, a spring, a first fixed ring, an atomizer, a silicone seal, a silicone plug, and a base; wherein the spring is disposed in the seal ring; the seal ring is disposed around the connector; the connector, the seal ring, and the spring are disposed in the first fixed ring; the silicone seal is disposed on the base; the base is disposed on the e-liquid tank; two ends of the first fixed ring are connected to the base and the e-liquid tank, respectively; the silicone plug is fixed on the base; and the atomizer is fixed on the first fixed ring.

The e-liquid tank has a volume of 4.6 mL.

The first fixed ring comprises an e-liquid inlet; when the atomizer is pulled out, the seal ring is rebounded to seal the e-liquid inlet.

The disclosure further comprises an electronic cigarette, comprising the aforesaid atomization assembly and a battery assembly.

The atomization assembly is disposed on the battery assembly; the battery assembly comprises a surface cover; two ends of the base are respectively provided with two fasteners; the surface cover comprises two grooves corresponding to the two fasteners so as to integrate the base and the surface cover; the atomization assembly is separated from the battery assembly by rotating the base by 90° with respect to the surface cover.

The battery assembly further comprises a joint, an anode spring, a silicone ring, a cathode rod, a clamp spring, a negative connector, a negative insulation ring, a second fixed ring, an airflow regulation ring, a support, a battery, a control panel, a button pad, a first face plate, a main body, a rotary button, a button, and a second face plate; the negative insulation ring is disposed in the second fixed ring; the cathode rod is disposed on the negative connector; the negative connector is disposed in the second fixed ring; the anode spring and the silicone ring are consecutively disposed around the joint, and the joint is disposed on the negative connector; the airflow regulation ring is disposed on the negative connector; the airflow regulation ring and the negative connector are disposed on the support; the surface cover is disposed on the support; the clamp spring is disposed on the joint; positive and negative terminals of the control panel are respectively connected to the joint and the cathode rod; positive and negative terminals of the battery are connected to the control panel; the battery and the control panel are disposed on the support; the button pad is disposed on the control panel; the support is disposed in the main body; the main body comprises a recess and the button is nested in the recess; the first face plate and the second face plate are respectively attached to two end faces of the main body; and the rotary button passes through a through hole of the main body and is fixed on the airflow regulation ring.

The atomization assembly can be separated from the battery assembly by rotating the base by 90° with respect to the surface cover. The atomization assembly comprises an elastic sealing device, which can prevent the e-liquid from flowing out of the e-liquid tank when the atomizer is pulled out. The airflow regulation ring is disposed in the battery assembly, and rotating the rotary button disposed on the upper part of the battery assembly can adjust the volume of the vapor. The battery has a capacity of 1300 mA/h, which is a large capacity compared with a conventional battery, so that the electronic cigarette has high output current and can produce large amount of vapor. The e-liquid tank 1 has a volume of 4.6 mL, which is large compared with a conventional e-liquid tank, thus extending the service life of the electronic cigarette.

DETAILED DESCRIPTION

To further illustrate, embodiments detailing an atomizer are described below. It should be noted that the following embodiments are intended to describe and not to limit the disclosure.

The disclosure provides an electronic cigarette, comprising an atomization assembly A and a battery assembly B.

Figure 1:
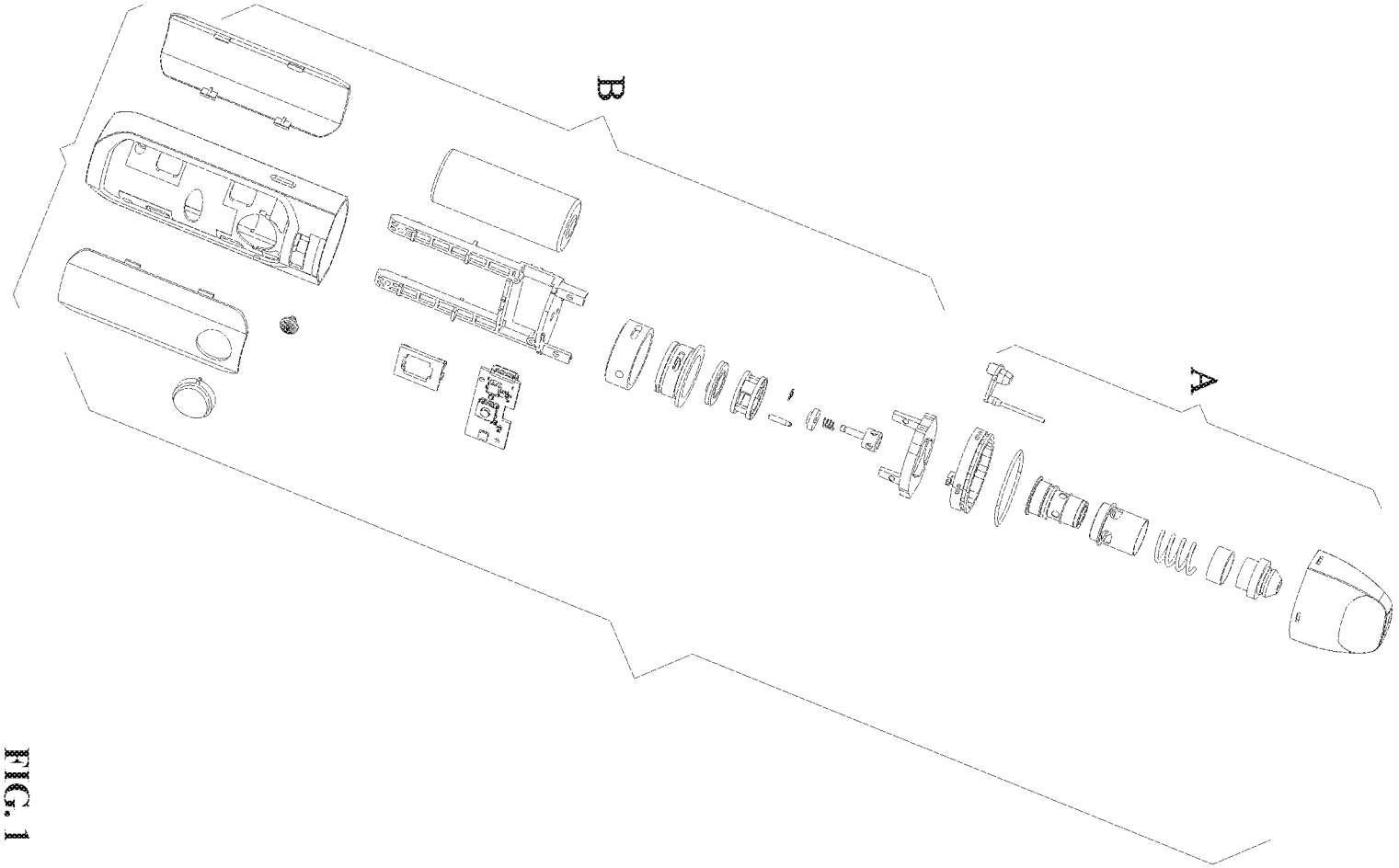
FIG. 1 is an exploded view of an electronic cigarette according to one embodiment of the disclosure.
Figure 2:
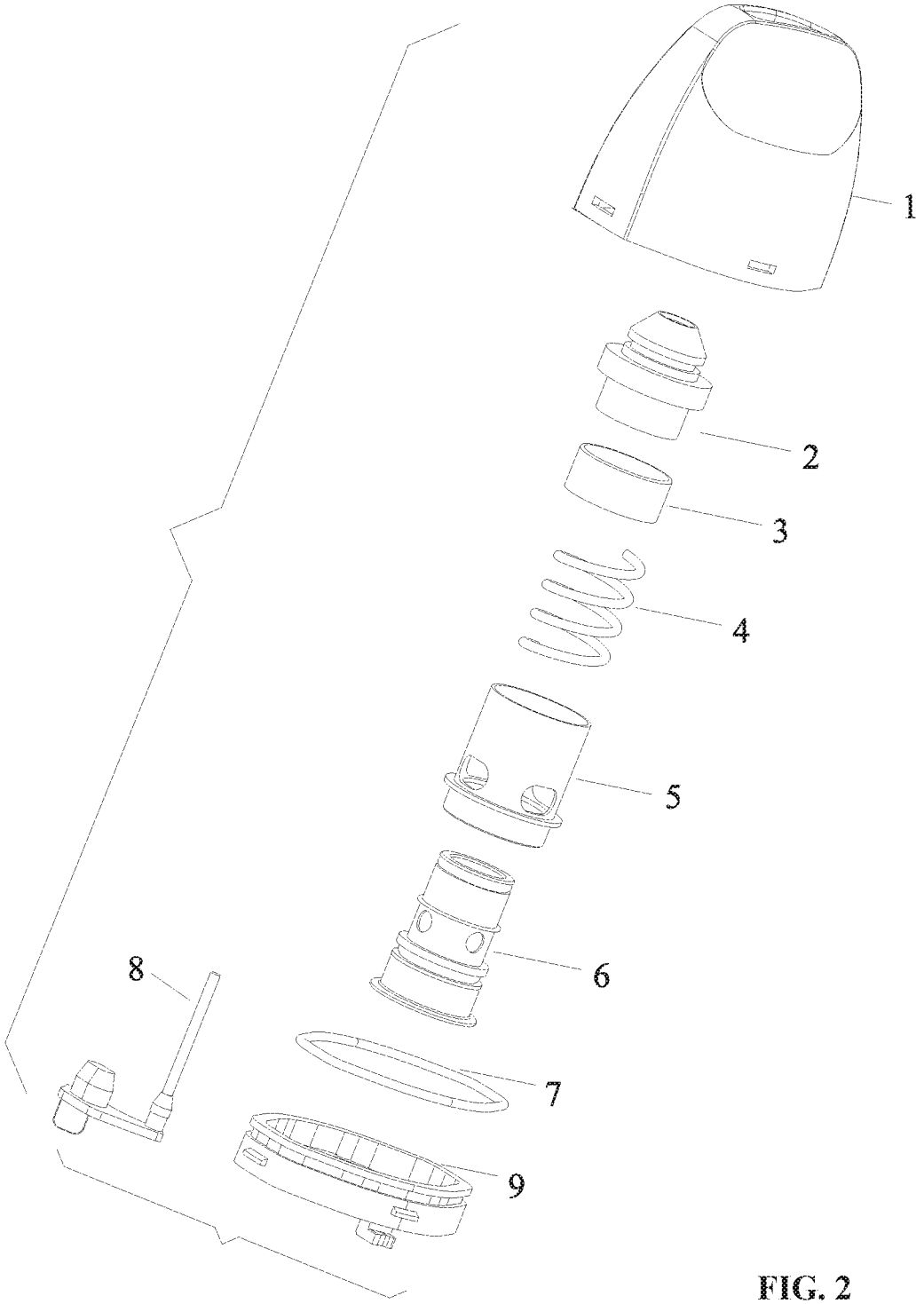
FIG. 2 is an exploded view of an atomization assembly of an electronic cigarette in FIG. 1.
Figure 3:
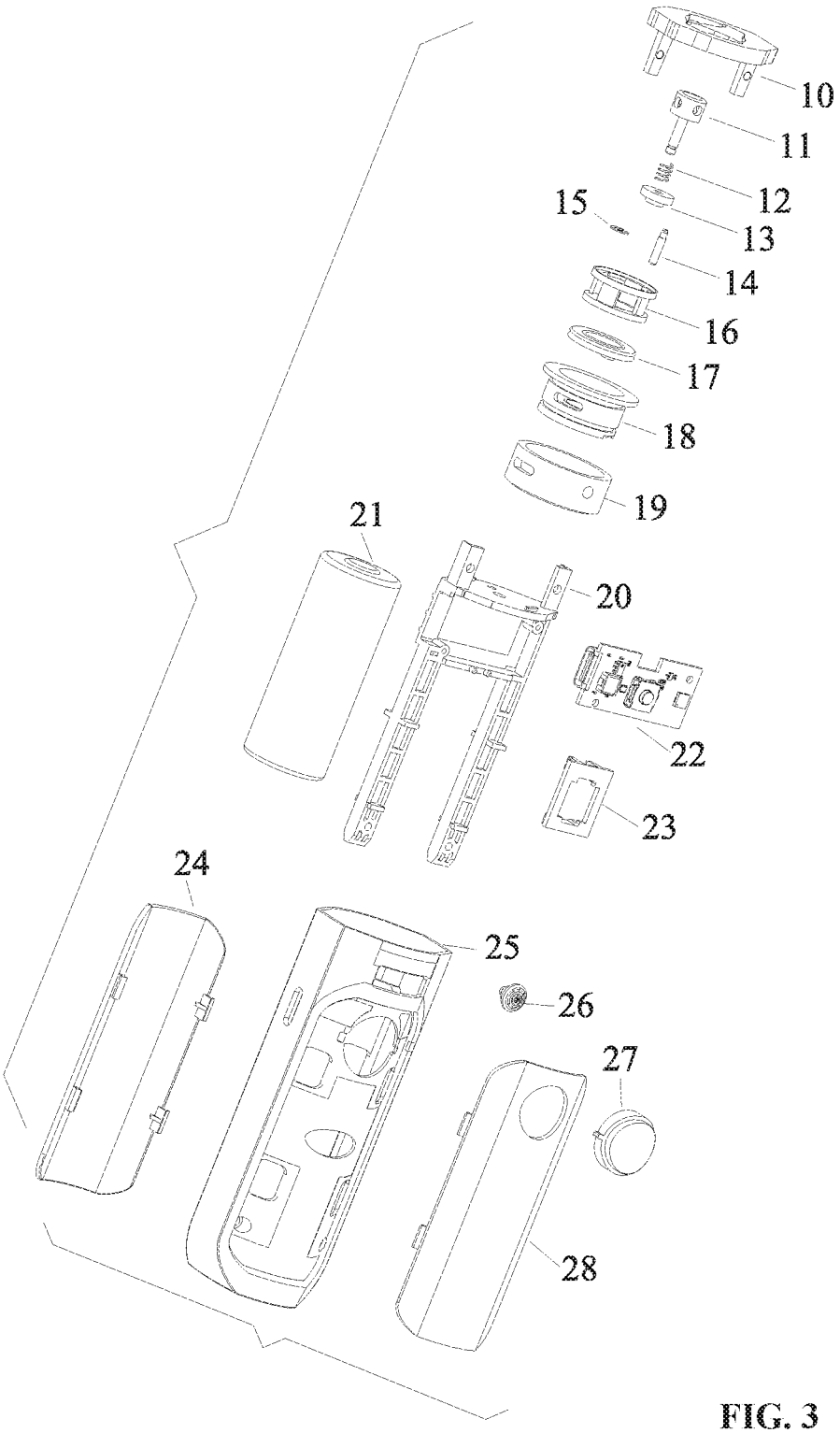
FIG. 3 is an exploded view of a battery assembly of an electronic cigarette in FIG. 1.
Figure 4:
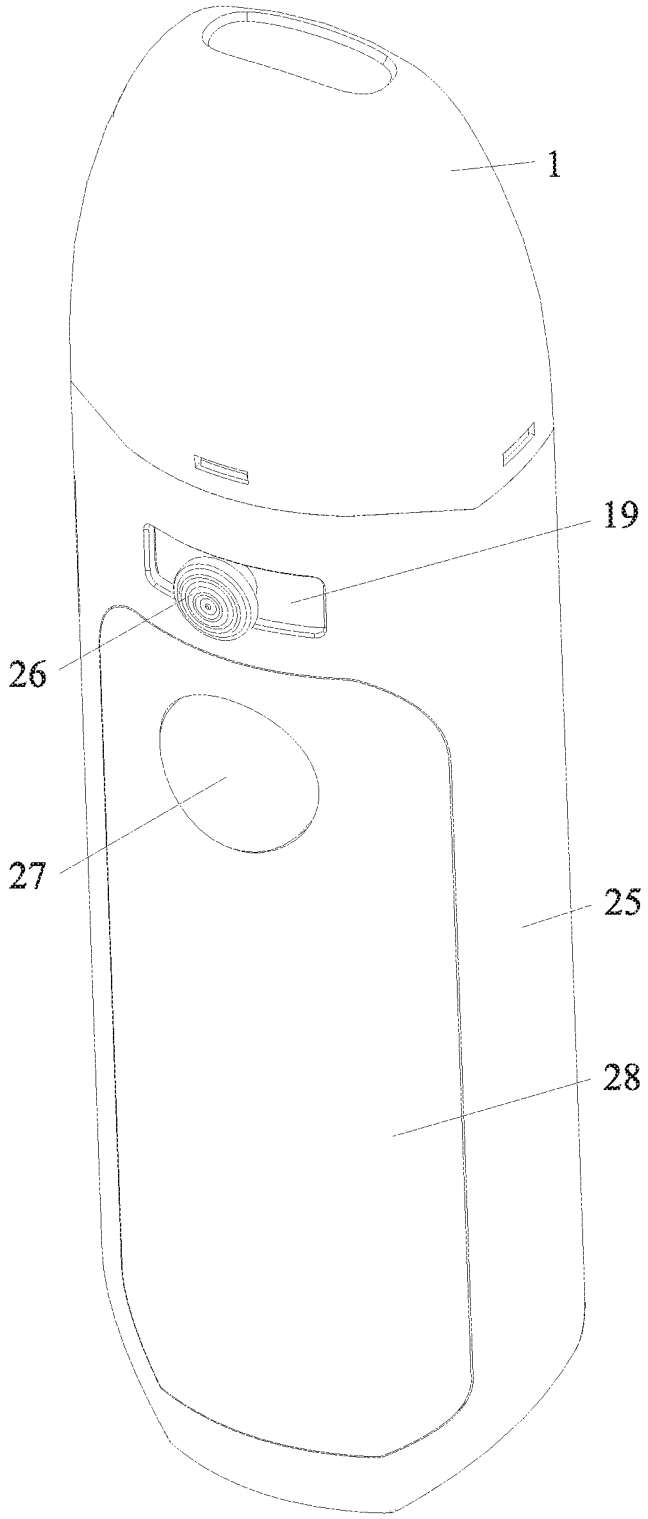
FIG. 4 is a schematic diagram of an electronic cigarette according to one embodiment of the disclosure.
Figure 5:
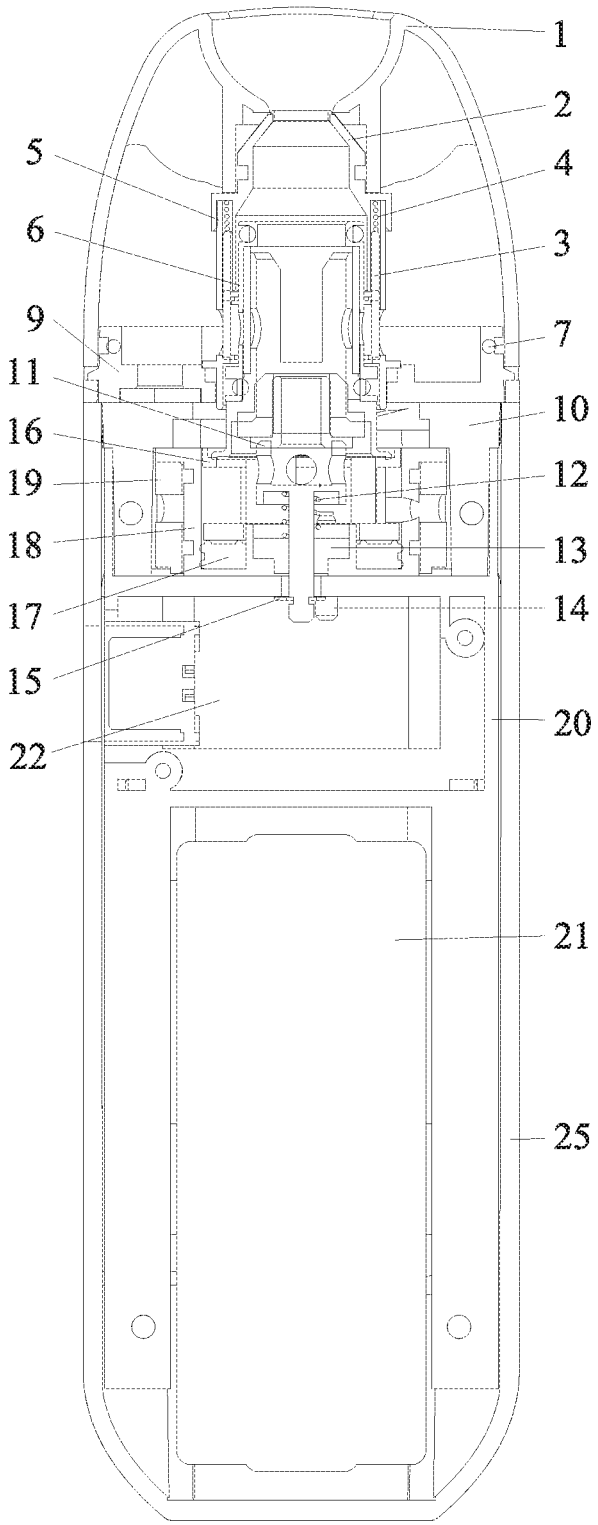
FIG. 5 is a sectional view of an electronic cigarette according to one embodiment of the disclosure.

As shown in FIGS. 1-5, the atomization assembly A comprises an e-liquid tank 1, a connector 2, a seal ring 3, a spring 4, a first fixed ring 5, an atomizer 6, a silicone seal 7, a silicone plug 8, and a base 9; wherein the spring 4 is disposed in the seal ring 3. The seal ring 3 is disposed around the connector 2; the connector 2, the seal ring 3, and the spring 4 are disposed in the first fixed ring 5; the silicone seal 7 is disposed on the base 9; the base is disposed on the e-liquid tank 1; two ends of the first fixed ring 5 are connected to the base 9 and the e-liquid tank 1, respectively; the silicone plug 8 is fixed on the base 9; and the atomizer 6 is fixed on the first fixed ring 5. The e-liquid tank 1 has a volume of 4.6 mL, which is large compared with a conventional e-liquid tank, thus extending the service life of the electronic cigarette. The atomization assembly further comprises an elastic sealing device, and the first fixed ring 5 comprises an e-liquid inlet; when the atomizer 6 is pulled out, the seal ring 3 is rebounded to seal the e-liquid inlet, thereby preventing the e-liquid from flowing out of the e-liquid tank.

The battery assembly B comprises a surface cover 10, a joint 11, an anode spring 12, a silicone ring 13, a cathode rod 14, a clamp spring 15, a negative connector 16, a negative insulation ring 17, a second fixed ring 18, an airflow regulation ring 19, a support 20, a battery 21, a control panel 22, a button pad 23, a first face plate 24, a main body 25, a rotary button 26, a button 27, and a second face plate 28; the negative insulation ring 17 is disposed in the second fixed ring 18; the cathode rod 14 is disposed on the negative connector 16; the negative connector 16 is disposed in the second fixed ring 18; the anode spring 12 and the silicone ring 13 are consecutively disposed around the joint 11, and the joint 11 is disposed on the negative connector 16; the airflow regulation ring 19 is disposed on the negative connector 16; the airflow regulation ring 19 and the negative connector 16 are disposed on the support 20; the surface cover 10 is disposed on the support 20; the clamp spring 15 is disposed on the joint 11; positive and negative terminals of the control panel 22 are respectively connected to the joint 11 and the cathode rod 14; positive and negative terminals of the battery 21 are connected to the control panel 22; the battery 21 and the control panel 22 are disposed on the support 20; the button pad 23 is disposed on the control panel 22; the support 20 is disposed in the main body 25; the main body 25 comprises a recess and the button 27 is nested in the recess; the first face plate 24 and the second face plate 28 are respectively attached to two end faces of the main body 25; and the rotary button 26 passes through a through hole of the main body 25 and is fixed on the airflow regulation ring 19.

The atomization assembly A is disposed on the battery assembly B; two ends of the base 9 are respectively provided with two fasteners; the surface cover 10 comprises two grooves corresponding to the two fasteners so as to integrate the base 9 and the surface cover 10; the atomization assembly A is separated from the battery assembly B by rotating the base by 90° with respect to the surface cover 10.

The airflow regulation ring 19 is disposed in the battery assembly and is connected to the rotary button 26. Rotating the rotary button 26 disposed on the upper part of the battery assembly can adjust the volume of the vapor produced by the evaporation of the e-liquid. The battery 12 has a capacity of 1300 mA/h, which is a large capacity compared with a conventional battery, so that the electronic cigarette has high output current and can produce large amount of vapor.

The following advantages is associated with the electronic cigarette of the disclosure:

1. The atomization assembly A can be separated from the battery assembly B by rotating the base by 90° with respect to the surface cover.

2. The atomization assembly comprises an elastic sealing device, which can prevent the e-liquid from flowing out of the e-liquid tank when the atomizer is pulled out.

3. The airflow regulation ring is disposed in the battery assembly, and rotating the rotary button disposed on the upper part of the battery assembly can adjust the volume of the vapor.

4. The battery has a capacity of 1300 mA/h, which is a large capacity compared with a conventional battery, so that the electronic cigarette has high output current and can produce large amount of vapor.

5. The e-liquid tank 1 has a volume of 4.6 mL, which is large compared with a conventional e-liquid tank, thus extending the service life of the electronic cigarette.

It will be obvious to those skilled in the art that changes and modifications may be made, and therefore, the aim in the appended claims is to cover all such changes and modifications.

What is claimed is:

1. An electronic cigarette, comprising an atomization assembly and a battery assembly; wherein:

the atomization assembly comprises an e-liquid tank, a connector, a seal ring, a spring, a first fixed ring, an atomizer, a silicone seal, a silicone plug, and a base; wherein the spring is disposed in the seal ring; the seal ring is disposed around the connector; the connector, the seal ring, and the spring are disposed in the first fixed ring; the silicone seal is disposed on the base; the base is disposed on the e-liquid tank; two ends of the first fixed ring are connected to the base and the e-liquid tank, respectively; the silicone plug is fixed on the base; and the atomizer is fixed on the first fixed ring;

the atomization assembly is disposed on the battery assembly; the battery assembly comprises a surface cover; two ends of the base are respectively provided with two fasteners; the surface cover comprises two grooves corresponding to the two fasteners so as to integrate the base and the surface cover; the atomization assembly is separated from the battery assembly by rotating the base by 90° with respect to the surface cover; and the battery assembly further comprises a joint, an anode spring, a silicone ring, a cathode rod, a clamp spring, a negative connector, a negative insulation ring, a second fixed ring, an airflow regulation ring, a support, a battery, a control panel, a button pad, a first face plate, a main body, a rotary button, a button, and a second face plate; the negative insulation ring is disposed in the second fixed ring; the cathode rod is disposed on the negative connector; the negative connector is disposed in the second fixed ring; the anode spring and the silicone ring are consecutively disposed around the joint, and the joint is disposed on the negative connector; the airflow regulation ring is disposed on the negative connector; the airflow regulation ring and the negative connector are disposed on the support; the surface cover is disposed on the support; the clamp spring is disposed on the joint; positive and negative terminals of the control panel are respectively connected to the joint and the cathode rod; positive and negative terminals of the battery are connected to the control panel; the battery and the control panel are disposed on the support; the button pad is disposed on the control panel; the support is disposed in the main body; the main body comprises a recess and the button is nested in the recess; the first face plate and the second face plate are respectively attached to two end faces of the main body; and the rotary button passes through a through hole of the main body and is fixed on the airflow regulation ring.

2. The electronic cigarette of claim 1, wherein the e-liquid tank has a volume of 4.6 mL.

3. The electronic cigarette of claim 1, wherein the first fixed ring comprises an e-liquid inlet; when the atomizer is pulled out, the seal ring is rebounded to seal the e-liquid inlet.

4. The electronic cigarette of claim 2, wherein the first fixed ring comprises an e-liquid inlet; when the atomizer is pulled out, the seal ring is rebounded to seal the e-liquid inlet.

* * * * *